US007125318B2

(12) United States Patent
Muldowney

(10) Patent No.: US 7,125,318 B2
(45) Date of Patent: Oct. 24, 2006

(54) POLISHING PAD HAVING A GROOVE ARRANGEMENT FOR REDUCING SLURRY CONSUMPTION

(75) Inventor: Gregory P. Muldowney, Glen Mills, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 3 days.

(21) Appl. No.: 10/712,362

(22) Filed: Nov. 13, 2003

(65) Prior Publication Data

US 2005/0106878 A1 May 19, 2005

(51) Int. Cl.
*B24B 1/00* (2006.01)
*B24B 5/00* (2006.01)

(52) U.S. Cl. ..... 451/41; 451/527; 451/285

(58) Field of Classification Search ..... 451/41, 451/60, 63, 285, 526–533
See application file for complete search history.

(56) References Cited

U.S. PATENT DOCUMENTS 5,177,908 A * 1/1993 Tuttle ..... 451/41
5,527,215 A * 6/1996 Rubino et al. ..... 451/527
5,645,469 A * 7/1997 Burke et al. ..... 451/41
5,650,039 A * 7/1997 Talieh ..... 216/89
5,990,012 A * 11/1999 Robinson et al. ..... 438/692
6,120,366 A * 9/2000 Lin et al. ..... 451/550
6,241,596 B1 6/2001 Osterheld et al.
6,843,711 B1 * 1/2005 Muldowney ..... 451/527
7,059,949 B1 * 6/2006 Elmufdi et al. ..... 451/527
2002/0068516 A1 * 6/2002 Chen et al. ..... 451/285

FOREIGN PATENT DOCUMENTS

EP 1 114 697 A2 7/2001

* cited by examiner

*Primary Examiner*—Hadi Shakeri
(74) *Attorney, Agent, or Firm*—Blake T. Biederman

(57) ABSTRACT

A polishing pad (200) that includes a polishing layer (204) having a polishing region (208) for polishing a wafer (220). The polishing layer includes a set of inflow grooves (232) that extend into the polishing region and a set of outflow grooves (236) that extend out of the polishing region. The inflow and outflow grooves cooperate with one another to enhance the utilization of a polishing slurry during polishing of the wafer.

10 Claims, 5 Drawing Sheets

POLISHING PAD HAVING A GROOVE ARRANGEMENT FOR REDUCING SLURRY CONSUMPTION

BACKGROUND OF THE INVENTION

The present invention generally relates to the field of chemical mechanical polishing. More particularly, the present invention is directed to a polishing pad having a groove arrangement for reducing slurry consumption.

In the fabrication of integrated circuits and other electronic devices, multiple layers of conducting, semiconducting and dielectric materials are deposited onto or removed from a surface of a semiconductor wafer. Thin layers of conducting, semiconducting and dielectric materials may be deposited by a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize workpieces, such as semiconductor wafers. In conventional CMP, a wafer carrier, or polishing head, is mounted on a carrier assembly. The polishing head holds the wafer and positions the wafer in contact with a polishing layer of a polishing pad within a CMP apparatus. The carrier assembly provides a controllable pressure between the wafer and polishing pad. Simultaneously therewith, a slurry, or other polishing medium, is flowed onto the polishing pad and into the gap between the wafer and polishing layer. To effect polishing, the polishing pad and wafer are moved, typically rotated, relative to one another. The wafer surface is polished and made planar by chemical and mechanical action of the polishing layer and slurry on the surface.

Important considerations in designing a polishing layer include the distribution of slurry across the face of the polishing layer, the flow of fresh slurry into the polishing region, the flow of used slurry from the polishing region and the amount of slurry that flows through the polishing zone essentially unutilized, among others. One way to address these considerations is to provide the polishing layer with grooves. Over the years, quite a few different groove patterns and configurations have been implemented. Prior art groove patterns include radial, concentric-circular, Cartesian-grid and spiral, among others. Prior art groove configurations include configurations wherein the depth of all the grooves are uniform among all grooves and configurations wherein the depth of the grooves varies from one groove to another.

It is generally acknowledged among CMP practitioners that certain groove patterns result in higher slurry consumption than others to achieve comparable material removal rates. Circular grooves, which do not connect to the outer periphery of the polishing layer, tend to consume less slurry than radial grooves, which provide the shortest possible path for slurry to reach the pad perimeter under the force of pad rotation. Cartesian grids of grooves, which provide paths of various lengths to the outer periphery of the polishing layer, hold an intermediate position.

Various groove patterns have been disclosed in the prior art that attempt to reduce slurry consumption and maximize slurry retention time on the polishing layer. For example, U.S. Pat. No. 6,241,596 to Osterheld et al. discloses a rotational-type polishing pad having grooves defining zigzag channels that generally radiate outward from the center of the pad. In one embodiment, the Osterheld et al. pad includes a rectangular "x-y" grid of grooves. The zigzag channels are defined by blocking selected intersections between the x- and y-direction grooves, while leaving other intersections unblocked. In another embodiment, the Osterheld et al. pad includes a plurality of discrete, generally radial zigzag grooves. Generally, the zigzag channels defined within the x-y grid of grooves or by the discrete zigzag grooves inhibit the flow of slurry through the corresponding grooves, at least relative to an unobstructed rectangular x-y grid of grooves and straight radial grooves. Another prior art groove pattern that has been described as providing increased slurry retention time is a spiral groove pattern that is assumed to push slurry toward the center of the polishing layer under the force of pad rotation.

Research and modeling of CMP to date, including state-of-the-art computational fluid dynamics simulations, have revealed that in networks of grooves having fixed or gradually changing depth, a significant amount of polishing slurry may not contact the wafer because the slurry in the deepest portion of each groove flows under the wafer without contact. While grooves must be provided with a minimum depth to reliably convey slurry as the surface of the polishing layer wears down, any excess depth will result in some of the slurry provided to polishing layer not being utilized, since in conventional polishing layers an unbroken flow path exists beneath the workpiece wherein the slurry flows without participating in polishing. Accordingly, there is a need for a polishing layer having grooves arranged in a manner that reduces the amount of underutilization of slurry provided to the polishing layer and, consequently, reduces the waste of slurry.

SUMMARY OF THE INVENTION

In one aspect of the invention, a polishing pad useful for polishing a surface of a semiconductor substrate, the polishing pad comprising: (a) a polishing layer that includes: (i) a central region; (ii) an outer peripheral edge spaced from the central region; and (iii) a generally annular polishing region configured to polish the surface of a workpiece and having an inner periphery adjacent the central region and an outer periphery spaced from the inner periphery; (b) a first plurality of grooves in the polishing layer, each groove of the first plurality of grooves having a first end located within the central portion and a second end located within the polishing region; and (c) a second plurality of grooves in the polishing layer, each groove of the second plurality of grooves spaced from ones of the first plurality of grooves and having a first end located within the polishing region and a second end located in at least one of: (i) the outer peripheral edge; and (ii) radially outward from the outer periphery of the polishing region.

In another aspect of the invention, a method of chemical mechanical polishing a semiconductor substrate, comprising the steps of: (a) providing a polishing pad comprising: (i) a polishing layer that includes: (A) a central region; (B) an outer peripheral edge spaced from the central region; and (C) a generally annular polishing region configured to polish the surface of the semiconductor substrate and having an inner periphery adjacent the central region and an outer periphery spaced from the inner periphery; (ii) a first plurality of grooves in the polishing layer, each groove of the first plurality of grooves having a first end located within the central portion and a second end located within the polishing region; and (iii) a second plurality of grooves in the polishing layer, each groove of the second plurality of grooves spaced from ones of the first plurality of grooves and having a first end located within the polishing region and a second end located in at least one of the outer peripheral edge and located radially outward from the outer periphery of the polishing region; and (b) providing a polishing solution to the central portion of the polishing pad.

In another aspect of the invention, a polishing system for use with a polishing solution to polish a surface of a semiconductor substrate, comprising: (a) a polishing pad comprising: (i) a polishing layer that includes: (A) a central region; (B) an outer peripheral edge spaced from the central region; and (C) a generally annular polishing region configured to polish the surface of the semiconductor substrate and having an inner periphery adjacent the central region and an outer periphery spaced from the inner periphery; (ii) a first plurality of grooves in the polishing layer, each groove of the first plurality of grooves having a first end located within the central portion and a second end located within the polishing region; and (iii) a second plurality of grooves in the polishing layer, each groove of the second plurality of grooves spaced from ones of the first plurality of grooves and having a first end located within the polishing region and a second end located in at least one of the outer peripheral edge and located radially outward from the outer periphery of the polishing region; and (b) a polishing solution delivery system for delivering the polishing solution to the central portion of the polishing pad.

DETAILED DESCRIPTION OF THE INVENTION

Figure 1:
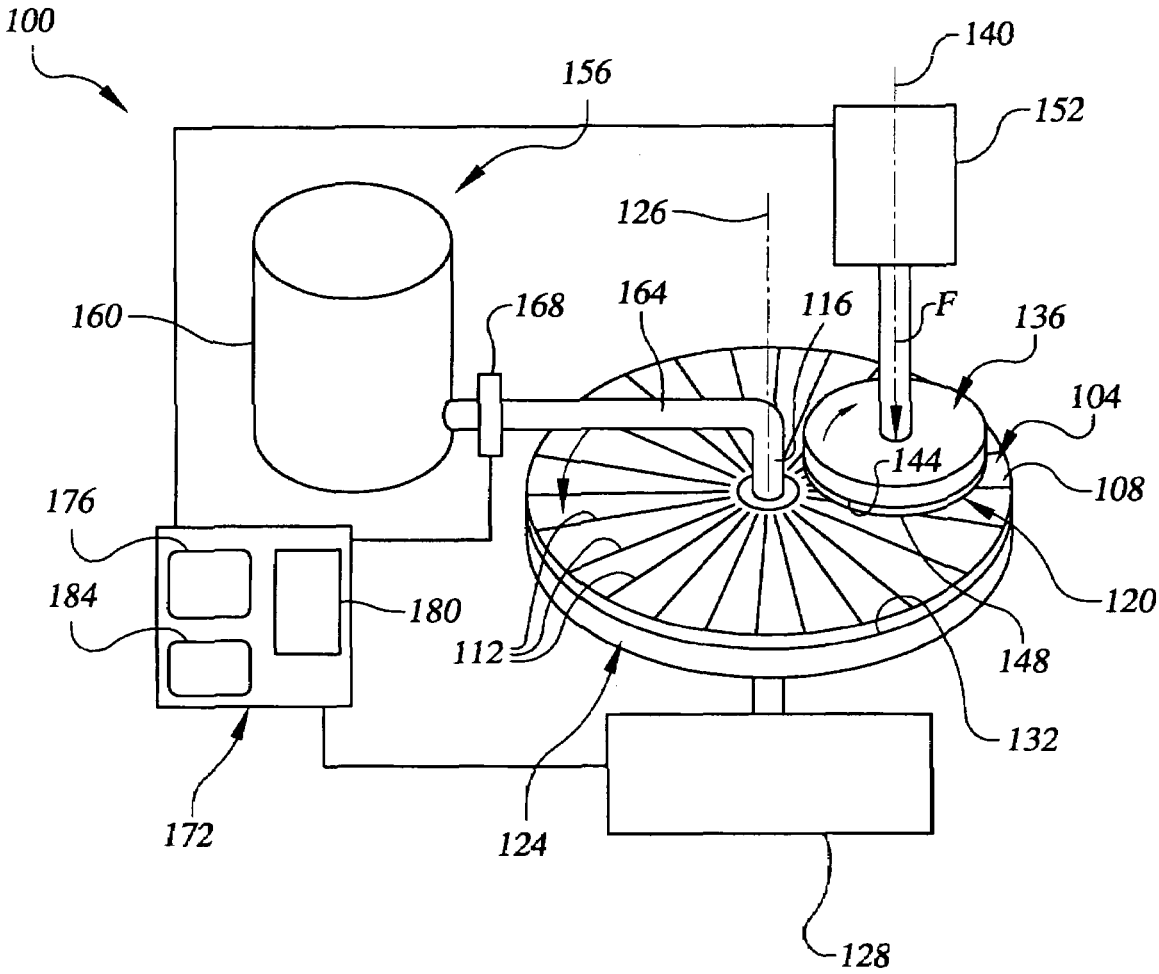
FIG. 1 is a partial schematic diagram and partial perspective view of a chemical mechanical polishing (CMP) system of the present invention.

Referring now to the drawings, FIG. 1 shows in accordance with the present invention a chemical mechanical polishing (CMP) system, which is generally denoted by the numeral 100. CMP system 100 includes a polishing pad 104 having a polishing layer 108 that includes a plurality of grooves 112 arranged and configured for enhancing the utilization of a slurry 116, or other liquid polishing medium, applied to the polishing pad during polishing of a semiconductor substrate, such as semiconductor wafer 120 or other workpiece, such as glass, silicon wafers and magnetic information storage disks, among others. For convenience, the term "wafer" is used in the description below. However, those skilled in the art will appreciate that workpieces other than wafers are within the scope of the present invention. Polishing pad 104 and its unique features are described in detail below.

CMP system 100 may include a polishing platen 124 rotatable about an axis 126 by a platen driver 128. Platen 124 may have an upper surface 132 on which polishing pad 104 is mounted. A wafer carrier 136 rotatable about an axis 140 may be supported above polishing layer 108. Wafer carrier 136 may have a lower surface 144 that engages wafer 120. Wafer 120 has a surface 148 that faces polishing layer 108 and is planarized during polishing. Wafer carrier 136 may be supported by a carrier support assembly 152 adapted to rotate wafer 120 and provide a downward force F to press wafer surface 148 against polishing layer 108 so that a desired pressure exists between the wafer surface and the polishing layer during polishing.

CMP system 100 may also include a slurry supply system 156 for supplying slurry 116 to polishing layer 108. Slurry supply system 156 may include a reservoir 160, e.g., a temperature controlled reservoir, that holds slurry 116. A conduit 164 may carry slurry 116 from reservoir 160 to a location adjacent polishing pad 104 where the slurry is dispensed onto polishing layer 108. A flow control valve 168 may be used to control the dispensing of slurry 116 onto pad 104.

CMP system 100 may be provided with a system controller 172 for controlling the various components of the system, such as flow control valve 168 of slurry supply system 156, platen driver 128 and carrier support assembly 152, among others, during loading, polishing and unloading operations. In the exemplary embodiment, system controller 172 includes a processor 176, memory 180 connected to the processor, and support circuitry 184 for supporting the operation of the processor, memory and other components of the system controller.

During the polishing operation, system controller 172 causes platen 124 and polishing pad 104 to rotate and activates slurry supply system 156 to dispense slurry 116 onto the rotating polishing pad. The slurry spreads out over polishing layer 108 due to the rotation of polishing pad 104, including the gap between wafer 120 and polishing pad 104. System controller 172 may also causes wafer carrier 136 to rotate at a selected speed, e.g., 0 rpm to 150 rpm, so that wafer surface 148 moves relative to the polishing layer 108. System controller 172 may further control wafer carrier 136 to provide a downward force F so as to induce a desired pressure, e.g., 0 psi to 15 psi, between wafer 120 and polishing pad 104. System controller 172 further controls the rotational speed of polishing platen 124, which is typically rotated at a speed of 0 to 150 rpm.

Figure 2:
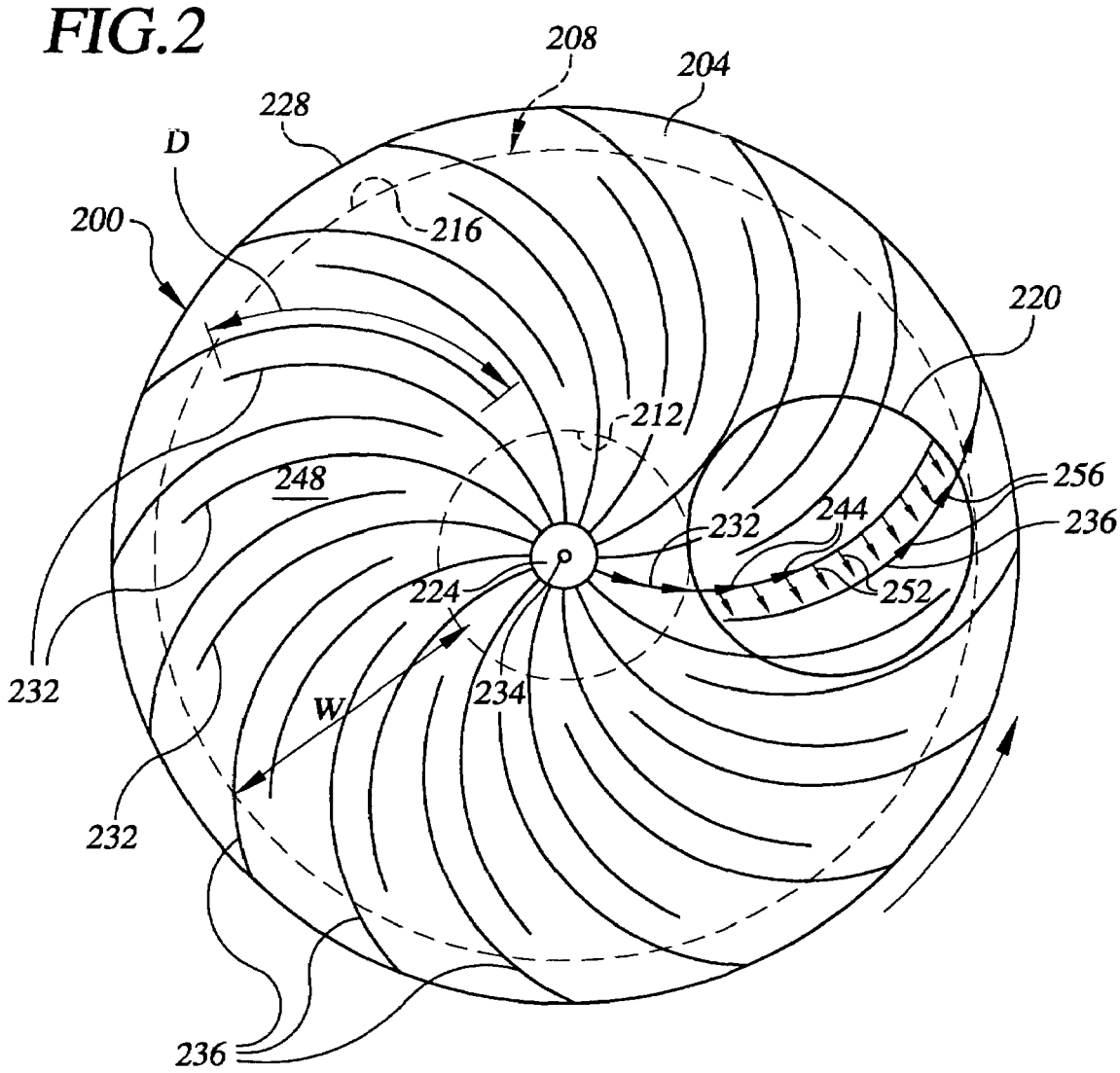
FIG. 2 is a plan view of a polishing pad of the present invention.

FIG. 2 shows an exemplary polishing pad 200 that may be used as polishing pad 104 of FIG. 1 or with other polishing systems utilizing similar pads. Polishing pad 200 includes a polishing layer 204 that contains a polishing region 208 (commonly referred to as the "wafer track" in the context of semiconductor wafer planarization) defined by an inner periphery 212 and an outer periphery 216. Polishing region 208 is that portion of polishing layer 204 that confronts the polished surface (not shown) of a wafer (indicated by an outline denoted numeral 220) during polishing as polishing pad 200 is rotated relative to the wafer. In the embodiment shown, polishing pad 200 is designed for use in CMP system 100 of FIG. 1, wherein wafer 120 (220) is rotated in a fixed position relative to polishing pad 104 (200). Consequently, polishing region 208 is annular in shape and has a width W equal to the diameter of the polished surface of wafer 220.

In an embodiment wherein wafer 220 is not only rotated but also oscillated in a direction parallel to polishing layer 204, polishing region 208 would typically likewise be annular, but width W between inner and outer peripheries 212, 216 would be greater than the diameter of the polished surface of the wafer to account for the oscillation envelope. Inner periphery 212 of polishing region 208 defines a central region 224 where a slurry (not shown), or other polishing solution, may be provided to polishing pad 200 during polishing. In an embodiment wherein wafer 220 is not only rotated but also oscillated in a direction parallel to polishing layer, inner periphery 212 of polishing region 208 may be exceedingly small if the oscillation envelope extends to, or nearly to, the center of polishing pad 200, in which case a slurry or other polishing solution may be provided to polishing pad at a slightly off-center location. Outer periphery 216 of polishing region 208 will typically be located radially inward of the outer peripheral edge 228 of polishing pad 200, but may alternatively be coextensive with this edge.

Polishing layer 204 generally includes a set of inflow grooves 232 that extend from within central region 224 into polishing region 208. When a slurry is provided to central portion 224 and polishing pad 200 is rotated about its rotational axis 234, inflow grooves 232 tend to act under the influence of centrifugal force to deliver the slurry to polishing region 208. Each inflow groove 232 terminates within polishing region 208 so as to not create a continuous channel from central region 224 through the polishing region and out of the polishing region at or adjacent outer peripheral edge 228 of polishing pad 200. Polishing layer 204 also includes a set of outflow grooves 236 spaced from inflow grooves 232. Outflow grooves 236 originate within polishing region 208 and terminate either radially outward of outer periphery 216 of the polishing region 208 or at peripheral edge 228 of polishing layer 204, or both. Generally, outflow grooves 236 are provided to capture spent slurry in polishing region 208 and convey the slurry toward peripheral edge 228 of polishing layer 204 and out from underneath wafer 220.

Generally, inflow and outflow grooves 232, 236 cooperate with one another as follows. As mentioned, when a slurry is provided to central portion 224 of polishing layer 204 and polishing pad 200 is rotated about its rotational axis 234, inflow grooves 232 tend to convey fresh slurry into polishing region 208. This flow is designated by arrows 244. As polishing pad 200 sweeps beneath wafer 220, the interaction between the polished surface of the wafer and the slurry within inflow grooves 232 beneath the wafer tends to draw fresh slurry out of these grooves, move it across upper surface 248 of polishing layer 204 (as indicated by arrows 252) and drive the slurry into adjacent outflow grooves 236. As slurry is drawn out of inflow grooves 232, fresh slurry tends to be drawn into these grooves from central region 224. Correspondingly, as slurry is driven into outflow grooves 236, spent slurry is drawn out of polishing region 208 by the outflow grooves that freely fluidly communicate with a region located out from underneath wafer 220. The flow of slurry in outflow grooves 236 is indicated by arrows 256.

An important aspect of inflow grooves 232 and outflow grooves 236 is that none of these grooves extend completely from one side of polishing region 208 to the other, i.e., from central portion 224 to a location radially outward of outer periphery 216 of the polishing region or to outer peripheral edge 228 of polishing layer 204 (or both). Therefore, an uninterrupted channel for the slurry to flow unutilized through polishing region 208 adjacent the bottom of the channel does not exist. Rather, the slurry is generally forced into utilization between the polished surface of wafer 220 and upper surface 248 of polishing layer 204 as the slurry is moved from each inflow groove 232 to an adjacent outflow groove 236 as polishing pad 200 rotates beneath the wafer.

In the embodiment shown, inflow and outflow grooves 232, 236 are arranged in an alternating manner with one outflow groove being flanked by two inflow grooves, and vice versa. In this arrangement, there is a corresponding respective outflow groove 236 for each inflow groove 232. However, in alternative embodiments, the arrangement of inflow and outflow grooves 232, 236 may be different, e.g., as shown below in FIG. 3. When inflow and outflow grooves 232, 236 are provided in an alternating arrangement, each pair of inflow and outflow grooves may extend alongside one another for a suitable distance D. Distance D may vary according to design parameters, such as the rotational speeds of wafer 220 and polishing pad 200, among others.

Inflow and outflow grooves 232, 236 may have any shape in plan view suitable for a particular design and by no means need be limited to the arcuate shapes shown. Other shapes include straight, zigzag, wavy and combinations of these, among others. In addition, inflow and outflow grooves 232, 236 need not be substantially radial, but rather may be skewed relative to lines radiating from rotational axis 234 of polishing pad 200. Those skilled in the art will readily appreciate the variety of groove patterns and configurations that fall within the scope of the present invention. Since a large number of variations exist, it is impractical, and not necessary, to list all possibilities.

Those skilled in the art will also appreciate that the number of inflow and outflow grooves 232, 236 shown on polishing pad 200 was selected to illustrate the invention conveniently. An actual polishing pad made in accordance with the present invention may have many more, or fewer, inflow and outflow grooves than shown, depending upon the size of the polishing pad and the intended application. In addition, inflow and outflow grooves 232, 236 may have any cross-sectional shape desired, such as generally U-shaped, rectangular, semicircular or V-shaped, among others. Polishing pad 200 may be of any conventional or other type construction. For example, polishing pad 200 may be made of a solid or microporous polyurethane, among other materials, and optionally include a compliant or rigid backing (not shown) to provide the proper support for the pad during polishing. Inflow and outflow grooves 232, 236 may be formed in polishing pad 200 using any process suitable for the material used to make the pad. For example, inflow and outflow grooves 232, 236 may be molded into polishing pad 200 or cut into the pad after the pad has been formed, among other ways. Those skilled in the art will understand how polishing pad 200 may be manufactured in accordance with the present invention. The features and alternatives described in this paragraph and the immediately preceding paragraph are equally applicable to polishing pads 300, 400 and 500 of FIGS. 3–5, respectively.

Figure 3:
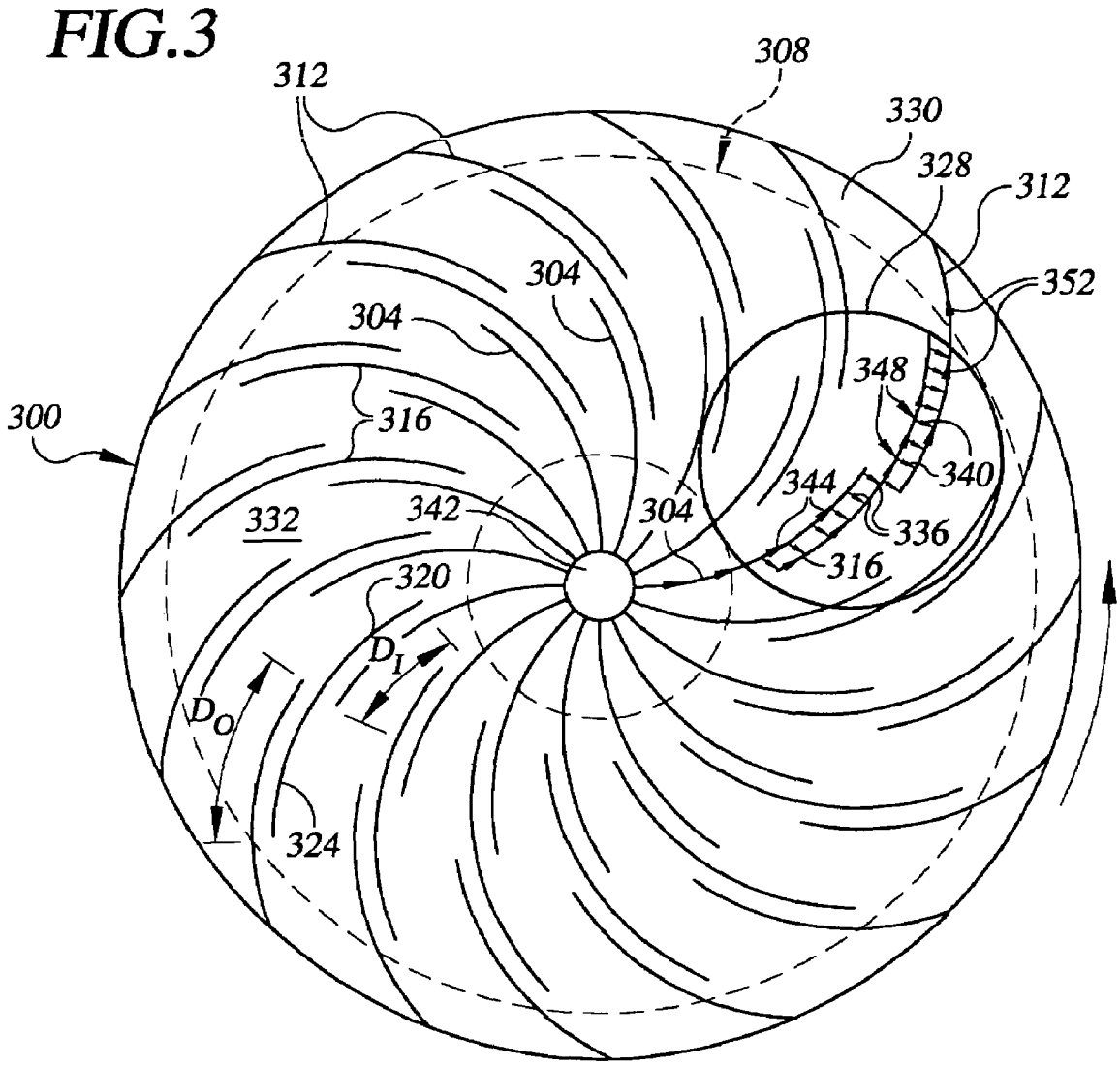
FIG. 3 is a plan view of an alternative polishing pad of the present invention.

FIG. 3 shows a second polishing pad 300 made in accordance with the present invention. Like polishing pad 200 of FIG. 2, polishing pad 300 of FIG. 3 includes a set of inflow grooves 304 for supplying fresh slurry (not shown) to polishing region 308 and a set of outflow grooves 312 spaced from the inflow grooves for carrying spent slurry out of the polishing region. However, polishing pad 300 further includes a set of intermediate grooves 316 spaced from both inflow grooves 304 and outflow grooves 312. Each intermediate groove 316 is generally located between a corresponding respective inflow groove 304 and a corresponding respective outflow groove 312. One end portion 320 of each intermediate groove 316 may extend alongside a portion of corresponding respective inflow groove 304 for a distance $D_I$. The opposite end portion 324 of each intermediate groove 316 may extend alongside a portion of corresponding respective outflow groove 312 for a distance $D_O$. The distances $D_I$, $D_O$ may be any desired to suit a particular design.

With this arrangement of inflow grooves 304, intermediate grooves 316 and outflow grooves 312, the movement of a slurry between wafer 328 and polishing layer 330 during polishing is generally as follows. As polishing layer 330 sweeps beneath wafer 328, the interaction between the polished surface (not shown) of the wafer and the slurry draws the slurry out of corresponding inflow grooves 304, moves the slurry across upper surface 332 of polishing layer 330 (arrows 336) and drives the slurry into end portions 320 of corresponding intermediate grooves 316. Similarly, the interaction between the polished surface of wafer 328 and the slurry draws the slurry out of end portions 324 of the corresponding intermediate grooves 316, moves the slurry across upper surface 332 of polishing layer 330 (arrows 340) and drives the slurry into corresponding outflow grooves 312. Simultaneously, the centrifugal force caused by the rotation of polishing pad 300 replaces the slurry drawn out of inflow grooves 304 with fresh slurry from central region 342 (arrows 344), moves the slurry in intermediate grooves 316 from end portions 320 to end portions 324 (arrows 348) and removes spent slurry from outflow grooves 312 (arrows 352).

The arrangement of inflow, intermediate and outflow grooves 304, 316, 312 may generally be considered to provide a slurry with a two-step path (arrows 336 and arrows 340) across upper surface 332 of polishing layer 330 between each pair of corresponding respective inflow and outflow grooves 304, 312. As those skilled in the art will appreciate, more than one intermediate groove 316 may be placed between each pair of corresponding inflow and outflow grooves 304, 312 so as to provide the slurry with a path having more than two steps. For example, three intermediate grooves (not shown) may be placed between a corresponding pair of inflow and outflow grooves 304, 312 so as to provide a four-step path for the slurry across upper surface 332 of polishing layer 330 within polishing region 308. The exact number and spacing of intermediate grooves 316 and the distances along which the intermediate grooves are correspondingly shaped are design variables that may be used to control the relative amount of slurry present at various radii across polishing region 308 and the relative slurry residence times in each region.

Figure 4:
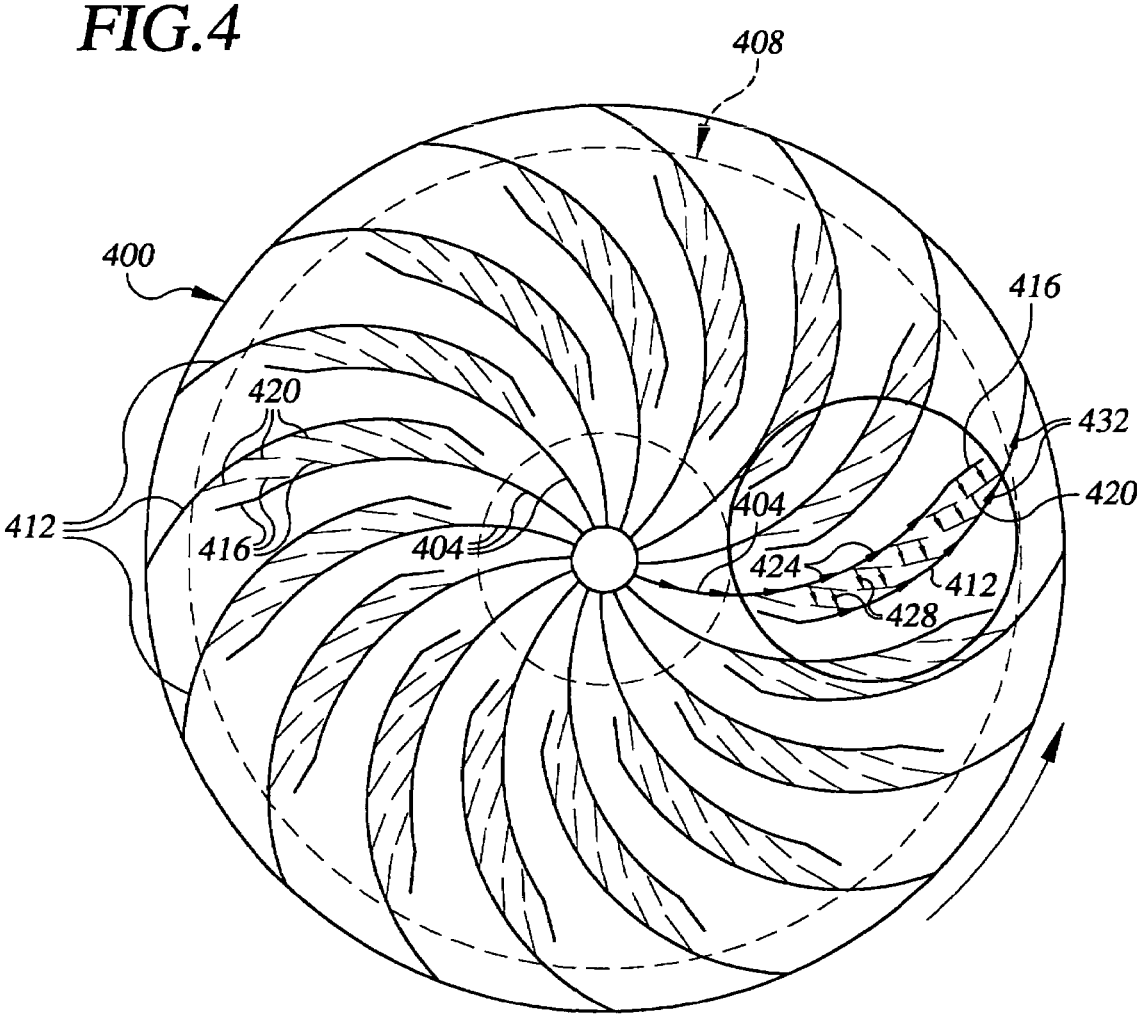
FIG. 4 is a plan view of another alternative polishing pad of the present invention.

FIG. 4 shows a third polishing pad 400 made in accordance with the present invention. Like polishing pad 200 of FIG. 2, polishing pad 400 of FIG. 4 includes a set of inflow grooves 404 for supplying fresh slurry (not shown) to polishing region 408 and a set of outflow grooves 412 spaced from the inflow grooves for carrying spent slurry out of the polishing region. However, in polishing pad 400 of FIG. 4 each inflow groove 404 serves as a distribution manifold for delivering slurry (not shown) to a plurality of branched distribution grooves 416 that essentially increase the effective length of that inflow groove. Similarly, each outflow groove 412 consolidates slurry from a plurality of branched collection grooves 420 that essentially increase the effective length of that outflow groove. The slurry path within inflow grooves 404, between branched distribution grooves 416 and branched collection grooves 420 and in outflow grooves 412 is illustrated, respectively, by arrows 424, arrows 428 and arrows 432.

Each branched distribution groove 416 and each branched collection groove 420 are typically provided only within polishing region 408. Each branched distribution and collection groove 416, 420 may have a transverse cross-sectional area less than the transverse cross-sectional area of the corresponding inflow and outflow grooves 404, 412 if desired. In addition, the transverse cross-sectional shape of each branched distribution and collection groove 416, 420 may be different from the transverse cross-sectional shape of corresponding inflow and outflow grooves 404, 412 if desired. Branched distribution and collection grooves 416, 420 may be oriented in any manner relative to corresponding inflow and outflow grooves 404, 412 and relative to one another. Thus, the orientation shown in FIG. 4 wherein branched distribution and collection grooves 416, 420 are skewed relative to the corresponding inflow and outflow grooves 404, 412 and parallel relative to each other is only one example of suitable orientations. Moreover, branched distribution and collection grooves 416, 420 may have any shape in plan view desired, such as linear (shown), arcuate, zigzag or wavy, among others.

Figure 5:
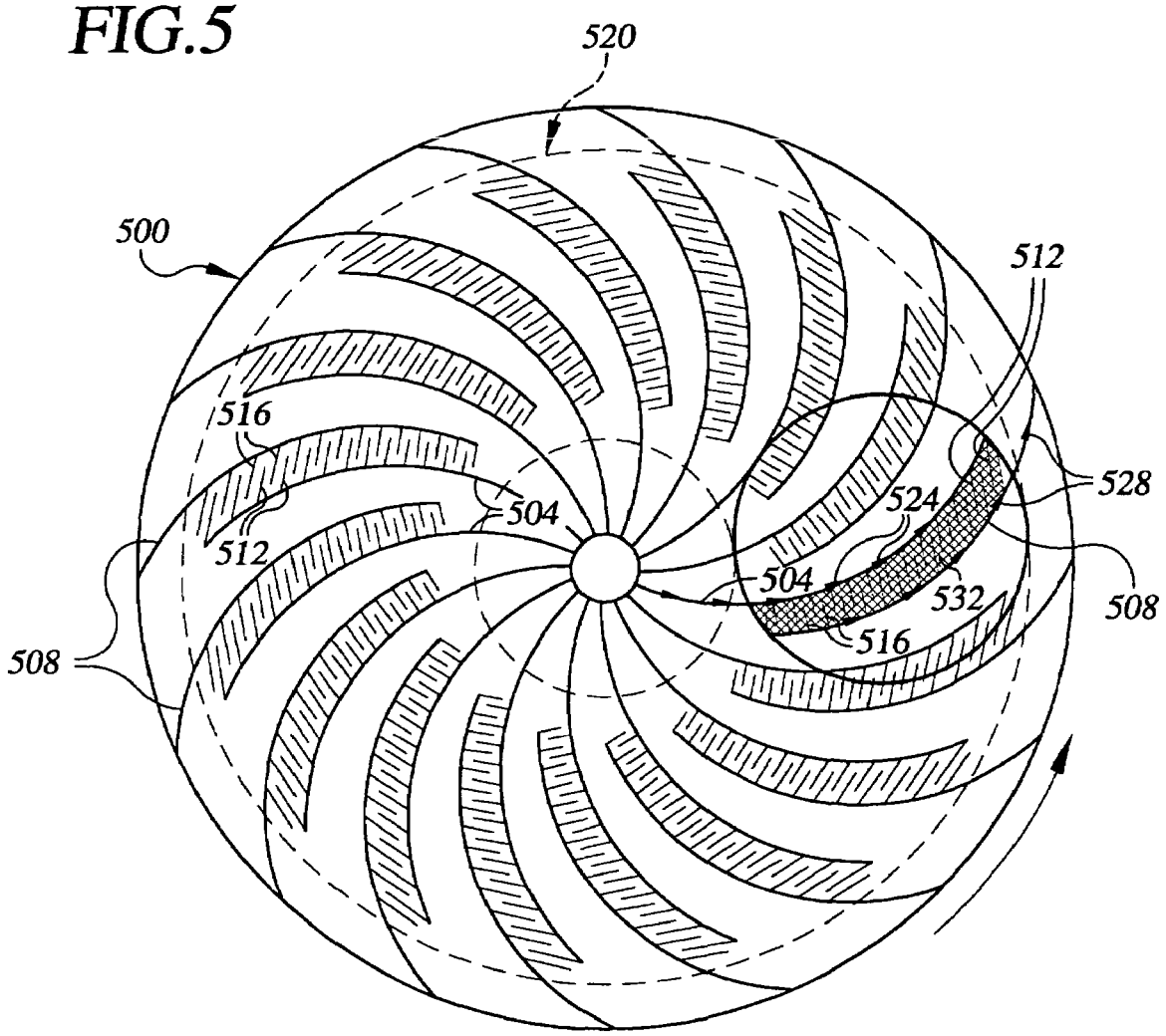
FIG. 5 is a plan view of yet another alternative polishing pad of the present invention.

FIG. 5 shows a fourth polishing pad 500 of the present invention that is generally a variation of polishing pad 400 of FIG. 4. That is, polishing pad 500 of FIG. 5 includes inflow grooves 504 and outflow grooves 508 and corresponding respective branched distribution and collection grooves 512, 516. The primary difference between polishing pad 500 of FIG. 5 and polishing pad 400 of FIG. 4 is that branched distribution grooves 512 of FIG. 5 are interdigitated with the corresponding respective branched collection grooves 516, whereas branched distribution grooves 416 of FIG. 4 are not interdigitated with the corresponding respective branched collection grooves 420. Other aspects of polishing pad 500 of FIG. 5 may be the same as the various aspects of polishing pad 400 of FIG. 4.

Interdigitating corresponding branched distribution and collection grooves 512, 516 may be used to form fine groove networks that can reduce the distance slurry must travel from a branched distribution groove to a corresponding branched collection groove and can result in a more even distribution of slurry within polishing region 520. The path of slurry within inflow grooves 504 and outflow grooves 508 is illustrated, respectively, by arrows 524 and arrows 528. The path of slurry between branched distribution grooves 512 and branched collection grooves 516 is represented by cross-hatching 532. If desired, branched distribution and collection grooves may have corresponding sub-branched grooves 512, 516, which may have sub-sub-branched grooves (not shown), and so on, for creating even finer groove networks.

The invention claimed is:

1. A polishing pad useful for polishing a surface of a semiconductor substrate, the polishing pad comprising:

(a) a rotational axis;

(b) a polishing layer that includes:

(i) a central region;

(ii) an outer peripheral edge spaced from the central region; and (iii) a generally annular polishing region configured to polish the surface of a workpiece and having an inner periphery adjacent the central region and an outer periphery spaced from the inner periphery;

(c) a first plurality of grooves in the polishing layer, each groove of the first plurality of grooves having a first end located within the central region and a second end located within the polishing region, the second end being radially inward of the outer peripheral edge and radially outward of the rotational axis; and (d) a second plurality of grooves in the polishing layer, each groove of the second plurality of grooves spaced from ones of the first plurality of grooves and having a first end located within the polishing region and a second end located radially outward of the second end of the first plurality of grooves in at least one of:

(i) the outer peripheral edge; and (ii) radially outward from the outer periphery of the polishing region.

2. The polishing pad according to claim 1, wherein the second end of each groove in the first plurality of grooves is located proximate the outer periphery of the polishing region and the first end of each groove in the second plurality of grooves is located proximate the inner periphery of the polishing region.

3. The polishing pad according to claim 1, wherein ones of the first plurality of grooves are located alternatingly with ones of the second plurality of grooves.

4. The polishing pad according to claim 1, further comprising a third plurality of grooves in the polishing layer, each groove of the third plurality of grooves located entirely within the polishing region.

5. The polishing pad according to claim 1, further including a first plurality of sets of branching distribution grooves in the polishing layer, each groove in each set located entirely within the polishing region and having an end in fluid communication with a corresponding respective groove of the first plurality of grooves; and a second plurality of sets of branching collection grooves in the polishing layer, each groove in each set located entirely within the polishing region and having an end in fluid communication with a corresponding respective groove of the second plurality of grooves.

6. A method of chemical mechanical polishing a semiconductor substrate, comprising the steps of:

(a) providing a polishing pad comprising:

(i) a rotational axis;

(ii) a polishing layer that includes:

(A) a central region;

(B) an outer peripheral edge spaced from the central region; and (C) a generally annular polishing region configured to polish the surface of the semiconductor substrate and having an inner periphery adjacent the central region and an outer periphery spaced from the inner periphery;

(iii) a first plurality of grooves in the polishing layer, each groove of the first plurality of grooves having a first end located within the central region and a second end located within the polishing region, the second end being radially inward of the outer peripheral edge and radially outward of the rotational axis; and (iv) a second plurality of grooves in the polishing layer, each groove of the second plurality of grooves spaced from ones of the first plurality of grooves and having a first end located within the polishing region and a second end located radially outward of the second end of the first plurality of grooves in at least one of the outer peripheral edge and located radially outward from the outer periphery of the polishing region; and (b) providing a polishing solution to the central region of the polishing pad.

7. The method according to claim 6, further including the step of rotating the polishing pad while the semiconductor substrate is in contact with the polishing layer such that at least a portion of the polishing solution moves from ones of the first plurality of grooves to ones of the second plurality of grooves.

8. The method according to claim 6, further including the step of rotating the polishing pad while the semiconductor substrate is in contact with the polishing layer such that at least a portion of the polishing solution moves from ones of the first plurality of grooves to corresponding immediately adjacent ones of the second plurality of grooves.

9. The method according to claim 6, further including the step of rotating the polishing pad while the semiconductor substrate is in contact with the polishing layer such that at least a portion of the polishing solution moves from ones of the first plurality of grooves to ones of a third plurality of grooves and from the third plurality of grooves to ones of the second plurality of grooves.

10. A polishing system for use with a polishing solution to polish a surface of a semiconductor substrate, comprising:

(a) a polishing pad comprising:

(i) a rotational axis;

(ii) a polishing layer that includes:

(A) a central region;

(B) an outer peripheral edge spaced from the central region; and (C) a generally annular polishing region configured to polish the surface of the semiconductor substrate and having an inner periphery adjacent the central region and an outer periphery spaced from the inner periphery;

(iii) a first plurality of grooves in the polishing layer, each groove of the first plurality of grooves having a first end located within the central region and a second end located within the polishing region, to second end being radially inward of the outer peripheral edge and radially outward of the rotational axis; and (iv) a second plurality of grooves in the polishing layer, each groove of the second plurality of grooves spaced from ones of the first plurality of grooves and having a first end located within the polishing region and a second end located radially outward of the second end of the first plurality of grooves in at least one of the outer peripheral edge and located radially outward from the outer periphery of the polishing region; and (b) a polishing solution delivery system for delivering the polishing solution to the central region of the polishing pad.

* * * * *